US005680785A

United States Patent [19]

Quehen et al.

[11] Patent Number: 5,680,785

[45] Date of Patent: Oct. 28, 1997

[54] METAL STRIP PLANISHING INSTALLATION

[75] Inventors: André Quehen, Pontoise; Bernard Rossigneux, Montbrison, both of France

[73] Assignee: Clecim, Cergy-Pontoise, France

[21] Appl. No.: 423,511

[22] Filed: Apr. 17, 1995

[30] Foreign Application Priority Data

Apr. 15, 1994 [FR] France ..... 94 04551

[51] Int. Cl.[6] ..... B21D 3/02

[52] U.S. Cl. ..... 72/10.1; 72/165

[58] Field of Search ..... 72/164, 165, 160, 72/10.1

[56] References Cited

U.S. PATENT DOCUMENTS

| | | | |
|---|---|---|---|
| 3,650,137 | 3/1972 | Benz | 72/165 |
| 4,454,738 | 6/1984 | Buta | 72/163 |
| 4,730,472 | 3/1988 | Ellis | 72/164 |

FOREIGN PATENT DOCUMENTS

| | | | |
|---|---|---|---|
| 274 722 | 7/1988 | European Pat. Off. . | |
| 570770 | 11/1993 | European Pat. Off. | 72/164 |
| 1 934 496 | 1/1971 | Germany . | |
| 1 552 086 | 6/1971 | Germany . | |

*Primary Examiner*—Daniel C. Crane

*Attorney, Agent, or Firm*—Pollock, Vande Sande & Priddy

[57] ABSTRACT

Installation for planishing a metal strip moving in a longitudinal feed direction, comprising a fixed supporting stand having two vertical members, lower and upper resistant bearing beams and lower and upper planishing roll systems each comprising a row of parallel live rolls that bears upon a support chassis via at least one row of bearing rolls. At least one of the planishing systems bears upon the corresponding bearing beam via a set of adjustable actuators interposed between the chassis of the system and the resistant bearing beam, the actuators being distributed across the entire surface covered by the system. The system is associated with a device for individually adjusting the position of the bearing end of each actuator in relation to the bearing beam in order to adjust and maintain the position of the chassis and live rolls in relation to the corresponding rolls of the other system for the adjustment of the imbrication of the rolls.

15 Claims, 5 Drawing Sheets

METAL STRIP PLANISHING INSTALLATION

BACKGROUND OF THE INVENTION

1. Field of the Invention

The invention relates to a metal strip planishing installation, and more particularly a so-called "multi-roll" installation.

2. Background of the Invention

For the planishing of flat products and, in particular, rolled metal strips, use is often made of a multi-roll planisher comprising two planishing systems each supporting a set of rolls with parallel axes and positioned, respectively, above and below the strip, the rolls being offset longitudinally and vertically in a manner so as to imbricate and set up an undulating path for the strip, which is thus subjected to the effects of stretching-rolling in alternate directions.

The assembly is placed in a fixed supporting stand on which means are mounted for adjusting the spacing of the two planishing systems allowing the imbrication of the rolls to be modified and, as a result, the planishing efficiency to be controlled.

The passage of the strip between the rolls along an undulating path tends to cause the two systems to move apart, and so it is necessary to permanently maintain imbrication by bearing upon the fixed stand.

A planishing installation therefore comprises, a fixed supporting stand, two planishing systems with parallel rolls, the planishing systems being respectively positioned above and below the strip, their rolls being so imbricated as to set up an undulating path for the strip, and means for adjusting and maintaining the spacing of the systems by bearing upon the fixed stand for the adjustment of the imbrication of the rolls, each planishing system including a row of parallel live rolls which bear upon a supporting chassis via at least one row of bearing rolls and which are each rotatably mounted, at their ends, on two bearings defining an axis of rotation perpendicular to the feed direction, the bearings being supported, respectively, by two side parts integral with the supporting chassis.

In most cases, the lower planishing system is fixed in position, the upper system being vertically movable for the adjustment of the spacing. For this purpose, use is generally made of four mechanical or hydraulic actuators mounted at the corners of the chassis and allowing adjustment of the general level of the adjustable system in relation to the fixed lower system and, as a result, adjustment of the imbrication of the rolls. Moreover, the actuators can be adjusted differently, thus allowing, if the need arises, the setting up of a forward/backward or sideways inclination of one system in relation to the other.

The forces produced for planishing are very high, particularly when the operation is performed on a strong metal sheet after hot rolling and accelerated cooling, or on a cold metal sheet. Endeavors are therefore made to provide planishers with a structure that is as rigid as possible so as to be able to control the planishing effects. To date, such planishers have therefore been very heavy, robust machines, simple in design and offering only limited adjustment possibilities.

However, in light of the evolution of products and customers' needs, it became clear that greater levels of planishing forces would have to be generated. Moreover, to satisfy increasingly stringent requirements, it seemed useful to provide the operator with means allowing the planishing stresses applied to the strip to be better distributed, and especially to differentiate the planishing rates between the center and edges of the sheet according to the nature of the flatness faults to be corrected.

SUMMARY OF THE INVENTION

The object of the invention is a new type of planishing machine which overcomes all these drawbacks without giving rise to excessive complication of the devices used.

In accordance with the invention, the chassis of at least one of the planishing systems bears upon the corresponding bearing beam via individually adjustable actuators distributed across the entire surface covered by the system, each actuator having an adjustable length and comprising one component which bears upon the bearing beam and one component which bears via one of its ends upon the chassis of the system, the latter being associated with means for individually adjusting the position of the bearing end of each actuator in relation to the bearing beam.

According to a preferred embodiment, each adjustable actuator of the deformable plate consists of a hydraulic or pneumatic jack comprising a jack body provided in a supporting part fixed on the bearing beam and a piston associated with a rod whose end facing the supporting chassis is provided with a preferably rounded bearing face. All the jacks of the adjustable system are connected to a supply circuit comprising means for individually adjusting the position of each jack.

Preferably, the adjustable actuators are arranged in rows corresponding, respectively, to each live roll or group of rolls, with each row comprising at least two actuators spaced from each other symmetrically on either side of the longitudinal median plane of the system. The number and distribution of the actuators are defined according to the size of the machine and in consideration of various technological constraints.

If a rigid chassis is used, such an arrangement already makes it possible to precisely vary the imbrication of the rolls between the input and output of the planisher by acting on the actuators in a manner so as to set up a slight inclination of the chassis .and, as a result, a slight inclination of the plane passing through the axes of the live rolls of the adjustable system in relation to the plane passing through the axes of the rolls of the other system.

It is, however, particularly advantageous to use a deformable chassis whose profile can be determined by the ends of the actuators on which it is applied, in a manner so as to vary the stress rate along the length of each roll.

To this end, each bearing roll is supported by two end bearings and at least one intermediate bearing, and the supporting chassis of the adjustable system comprises a deformable continuous plate extending between the two side parts supporting the end bearings of the live rolls and on which at least the intermediate bearings of the bearing rolls bear, the deformable plate itself bearing, on its side furthest from the product, upon the ends of the actuators and thus reproducing the profile defined by the actuator ends with a corresponding deformation of the bearing rolls.

For example, the position of the actuators can be adjusted in advance to give the bearing surface a profile determined according to the characteristics of the product to be planished and any foreseeable deformations of the different parts of the supporting stand. In this case, the actuators can be adjusted mechanically.

It is, however, particularly advantageous to have the possibility of modifying the profile of the bearing surface during the passage of the strip, especially so as to be able to correct flatness faults detected downstream and/or to compensate for deformations of the stand measured at each instant, for example by means of sensors, arranged between the bearing beam or the deformable plate and a reference rule not subject to deformations.

Each live roll is normally made up of a series of aligned rollers supported by spaced centering bearings, mounted on supporting members bearing upon the deformable plate at points distributed across its surface in rows parallel to the axes of the rolls. The actuators are advantageously distributed in the same way, each centering bearing being associated with an actuator.

However, according to a simpler embodiment, the number of actuators can be reduced by distributing them between the centering bearings of the rolls, the deformable plate ensuring distribution of forces.

According to another feature of the invention, the chassis of the upper planishing system is supported by at least three hydraulic or pneumatic jacks bearing upon the fixed stand in a manner so as to press the deformable plate against the adjustable actuators, the jacks being supplied under a pressure which is at least able to balance the weight of the planishing system.

The fixed stand normally comprises a lower bearing beam resting on the foundation block, two side vertical members fixed onto the lower bearing beam and an upper bearing beam on which the adjustable system bears.

According to a particularly advantageous arrangement, the upper bearing beam is mounted so as to slide vertically along two side vertical members of the supporting stand and the adjustable system is supported by the bearing beam in a manner so as to move with it between an open position for introducing the strip for which the adjustable system is well distanced from the fixed planishing system, and a tightened planishing position corresponding to a predetermined spacing of the planishing systems, from which the imbrication of the rolls is adjusted by the actuators.

Preferably, each side vertical member of the stand is made up of two spaced columns, the movable bearing beam being provided with four guide sleeves which respectively slide onto the columns, and which in the tightened position come to bear against the corresponding parts of the fixed bearing beam, each column being associated with a jack controlling the sliding movement of the movable bearing beam, between a tightened planishing position and an open position. The control jacks can be supplied under low pressure for the movement of the movable bearing beam between the open position and tightened position and inversely, and under high pressure, in the tightened position, for preloading the columns of the stand in order to oppose the yield of the stand when planishing is in progress.

BRIEF DESCRIPTION OF THE DRAWINGS

The invention will be better understood from the following description of a number of different embodiments of the invention, provided by way of example and shown in the accompanying drawings.

DESCRIPTION OF THE PREFERRED EMBODIMENTS

Figure 1:
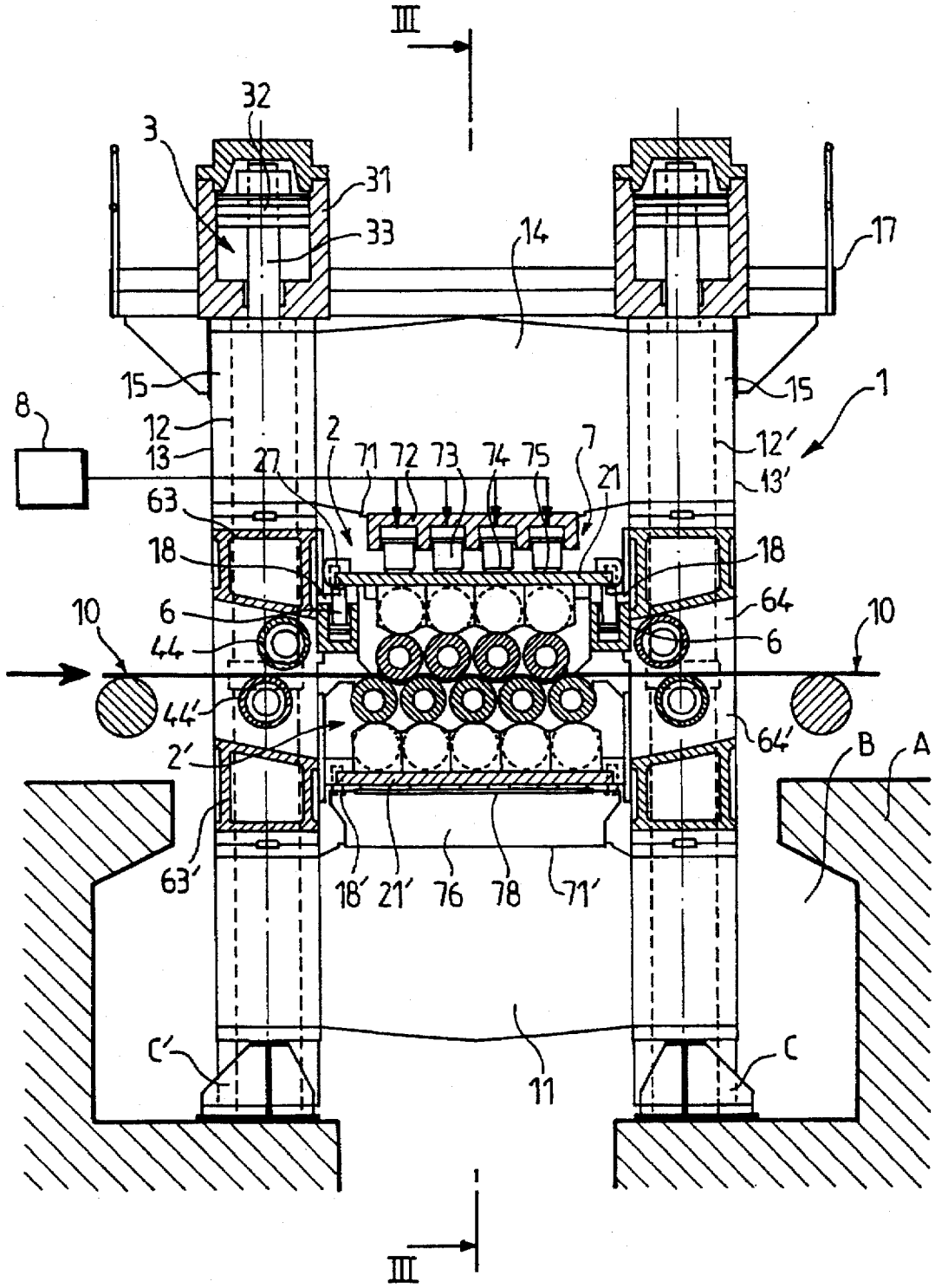
FIG. 1 is a cross-sectional view in elevation of the installation as taken in its vertical median plane parallel to the feed direction, the planishing systems being shown in the tightened position.
Figure 2:
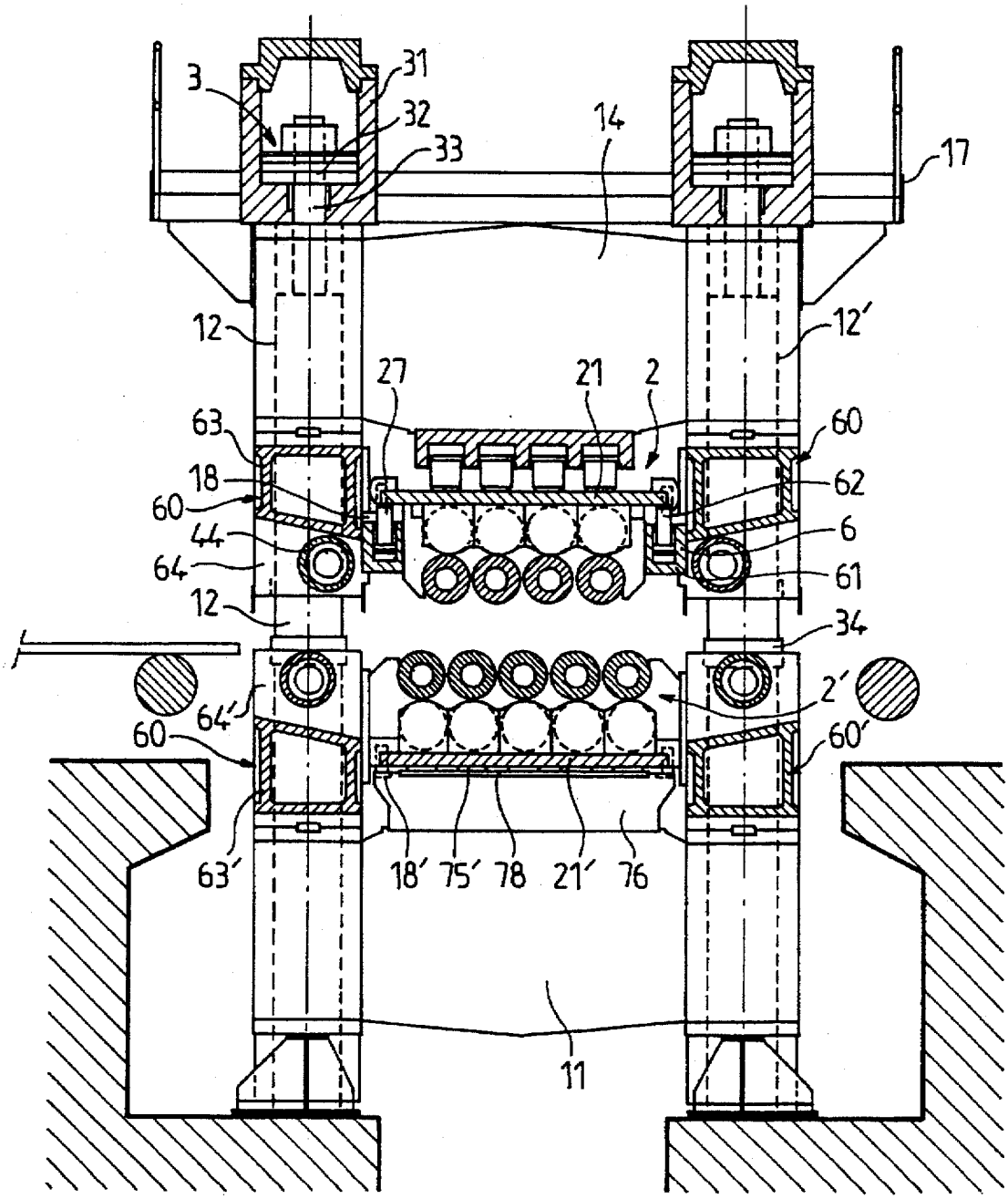
FIG. 2 is a view similar to FIG. 1, with the planishing systems in the open position.
Figure 3:
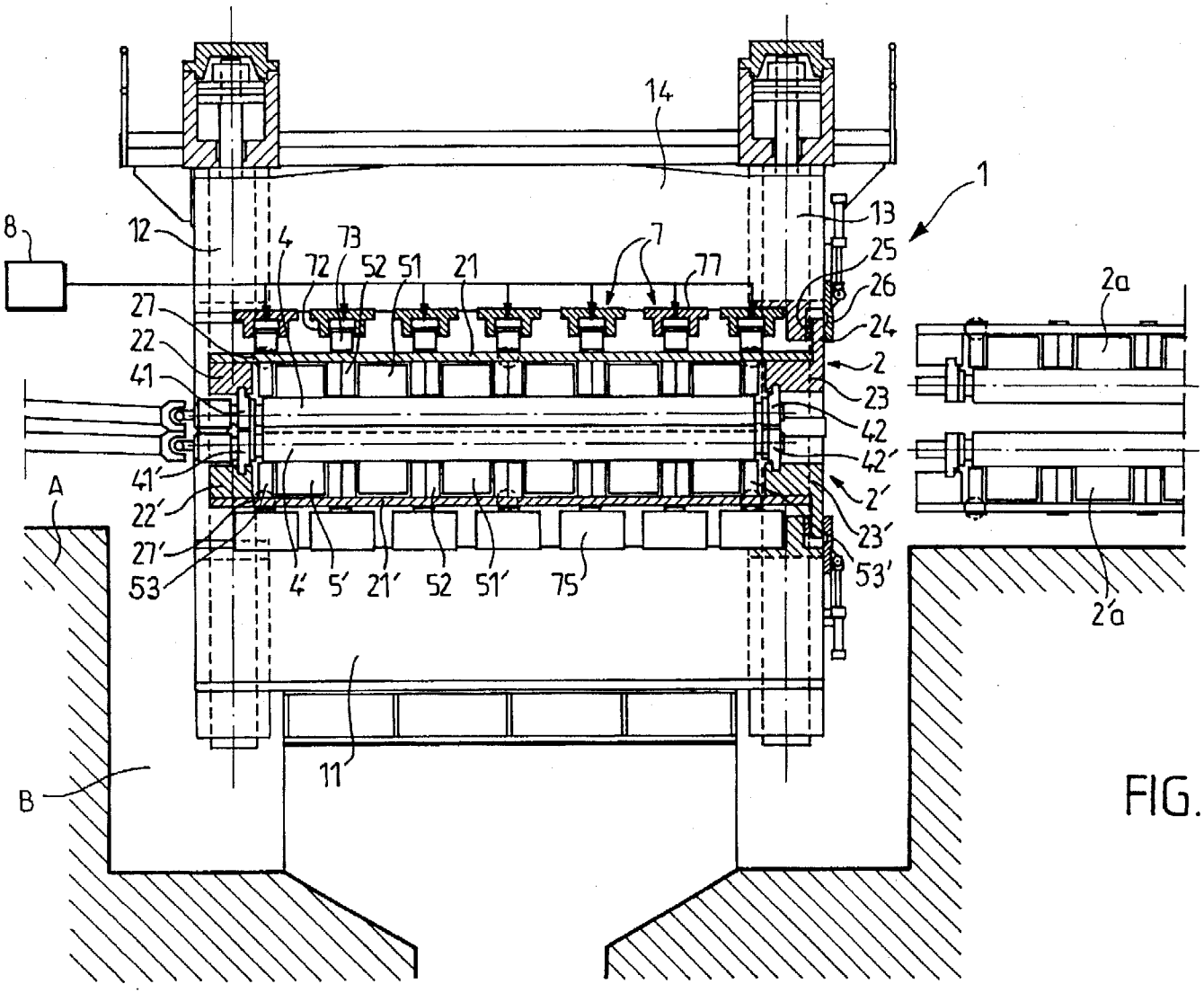
FIG. 3 is a cross-sectional view along line III—III of FIG. 1.

FIGS. 1, 2 and 3 show a planishing installation of the invention comprising, a supporting stand 1 and a multi-roll upper planishing system 2 and lower planishing system 2'.

The fixed supporting stand 1 comprises a lower bearing beam 11, two side vertical members 12, 13, placed in position on either side of a longitudinal median feeding plane P of strip 10 to be planished and an upper bearing beam 14.

Considering the dimensions of such an installation, the lower part thereof can advantageously be positioned in a pit B provided in a foundation block A supporting two spaced rigid base beams C, C', which form a fixed seating block on which lower bearing beam 11 rests.

In addition, the two bearing beams, i.e., lower beam and beam 14, each comprise a welded mechanical structure in the form of a substantially rectangular rigid slab that covers the entire surface covered by planishing systems 2, 2' between vertical side members 12, 13.

According to an advantageous embodiment, each vertical side member 12 (13) comprises a pair of spaced columns 12, 12' (13, 13') which slide in hollow parts in the form of sleeves 15 with vertical axes, provided at the four corners of lower bearing beam 11, each column being secured in position by a nut 16.

Upper bearing beam 14, which similarly constitutes a rigid rectangular slab, is also provided, at its corners, with four hollowed parts 15' in the form of sleeves which slide on the upper parts of the four columns 12, 12', 13, 13'.

Upper bearing beam 14 can thus slide along the four columns 12, 12', 13, 13' under the action of four hydraulic jacks 3 each comprising a jack body 31 fixed to bearing beam 14 above the corresponding hollow part 15', and a piston 32 integral with a rod 33 fixed to the corresponding column 12, 12', 13, 13'.

Preferably, the upper part of bearing beam 14 is designed to form a platform 17.

While lower bearing beam 11 is fixed, upper bearing beam 14 can move, under the action of the four jacks 3, between a lowered position as shown in FIG. 1 and a raised position as shown in FIG. 2, pistons 32 of the jacks remaining at the same level.

Each planishing system comprises a row of live rolls 4 associated with a row of bearing rolls 5, the assembly being supported by a chassis 2. According to an essential feature of the invention, chassis 2 essentially comprises a rectangular deformable continuous plate 21 covering the entire surface covered by the rolls, and two longitudinal girders 22, 23 each comprising an elongated part, the girders being fixed onto the sides of plate 21 parallel to the strip feed direction.

Each live roll 4 is rotatably mounted on two bearings 41, 42, mounted respectively on longitudinal girders 22, 23 of chassis 2 and defining an axis of rotation 40 of the roll perpendicular to the feed direction of strip 10.

In the examples shown in the drawing figures, each live roll 4 bears upon a bearing roll 5 rotatably mounted on two end bearings, said bearing roll 5 comprising a series of aligned rollers 51 turning on two end bearings 53 and spaced intermediate bearings 52, each bearing being mounted on a supporting member fixed directly on deformable plate 21 of chassis 2.

Figure 5:
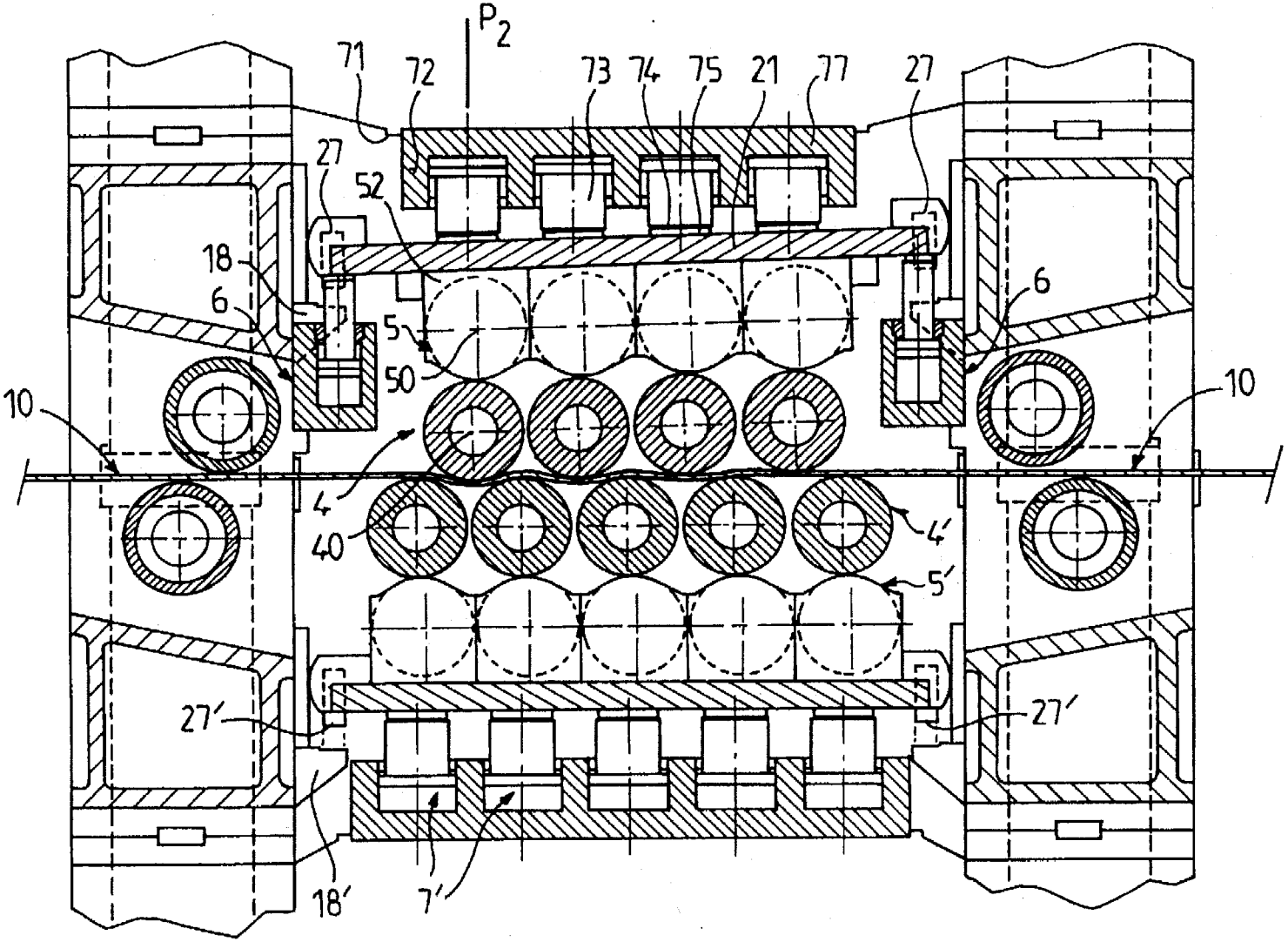
FIG. 5 is an enlarged-scale view of the assembly of the two planishing systems in the embodiment shown in FIG. 4.

Preferably, as can be seen in FIGS. 1 and 5, the axis of rotation 50 of each bearing roll 5 is slightly offset upstream of the direction of product feed, in relation to axis 40 of corresponding live roll 4.

Moreover, at least one of the two longitudinal girders 23 of chassis 2 is provided with a vertical prolongation 24 which is held applied, with the possibility of vertical sliding, between an end-stop 25 of the corresponding beam and a movable lock 26. As a result, it is possible to adjust the spacing of the two planishing systems without risk of horizontal shift.

As shown in FIGS. 2 and 5, upper planishing system 2 is supported by four hydraulic jacks 6 whose body 61 is fixed to upper bearing beam 14 and whose rod 62 bears upon the side of deformable plate 21.

Preferably, jacks 6 are fixed in pairs onto two horizontal beams 63 extending respectively on either side of chassis 2, below upper bearing beam 14, and between the latter and the feed plane of the strip, with each having at their ends two sleeves 64 which slide on, respectively, columns 12, 12', 13, 13', and placed in position in the extension of corresponding sleeves 15 of bearing beam 14. The assembly formed by each beam 63 and its two associated sleeves 64 forms a distance piece 60 which can be rigidly locked with beam 14 so as to move vertically with it by sliding along columns 12, 13 and as a result carry along associated planishing system 2.

Advantageously, each distance piece 60 can be associated with a deflecting roll 44 extending below beam 63 and turning on two bearings supported by sleeves 64.

Distance pieces 60', produced in the same way, are placed in position below the feed plane of strip 10 and fixed onto lower bearing beam 11.

According to an essential feature of the invention, at least chassis 2 of the upper system bears upon bearing beam 14 via a set of adjustable actuators 7 distributed across the entire surface of deformable plate 21 and interposed between it and the facing face 71 of bearing beam 14.

As shown in the drawing figures, adjustable actuators 7 advantageously comprise a plurality of hydraulic jacks 7 arranged in several parallel rows, and each comprising a jack body 72 in which a piston can slide associated with a rod 73 guided vertisally in jack body 70, and whose lower end bears upon deformable plate 21 via a rounded face 74 allowing a slight inclination of the plate in relation to the axis of each jack 7.

To reduce the wear of deformable plate 21, it can be provided with several rows of small plates 75 each corresponding to a jack 70 and being make of from break-proof steel.

The number of jacks 7 depends on the results desired. Preferably, however, each live roll 4 of the upper planishing system is associated with a row 70 of jacks 7 distributed over the entire length of the roll and centered in a vertical plane P2 passing substantially through axis 40 of corresponding live roll 4.

As already mentioned, each live roll 4 is normally associated with a bearing roll 5 comprising a series of rollers 51 supported by bearings 52. Preferably, an identical number of bearing jacks 7 will be arranged and distributed in the same way such that each jack 7 bears upon deformable plate 21 flush with one of the bearings 52 of bearing roll 5.

In this case, as shown in FIG. 1, bodies 72 of adjacent jacks 7 associated respectively with the different live rolls 4 will advantageously be grouped in strips 77 parallel to the feed direction.

However, in order to simplify manufacture, the number of actuators 7 could be reduced by associating them with groups of live rolls, each row of actuators 7 being centered, for example, on a vertical plane passing between two adjacent live rolls.

As shown in FIG. 5, the relative positions of bearing jacks 7 can be adjusted so as to give the upper system a certain angle of forward/backward or sideways inclination in relation to the fixed system.

Accordingly, jacks 6 which press chassis 2 against actuators 7 also assume different positions according to the orientation given to the deformable plate.

However, it should be noted that the rigidity of the deformable plate is maintained along its lateral sides parallel to the longitudinal axis by two longitudinal girders 22, 23 supporting bearings 41 of live rolls 4, which therefore remain aligned on each side of plate 21 but possibly in different directions.

Each lower planishing system 2' is advantageously identical to planishing system 2, and therefore comprises a row of live rolls 4' associated with a row of bearing rolls 5' comprising rollers 51' turning on bearings 52' which bear upon a plate 21. Plate 21 is provided, on two sides, with longitudinal girders 22', 23' on which bearings 41', 42' of live rolls 4' are mounted.

As a result, the two planishing systems can be identical and interchangeable. Each system constitutes a cartridge whose chassis 2, 2' can be provided with rollers 27, 27' rolling on rails 18, 18' perpendicular to the feed axis and fixed, advantageously, on distance pieces 7*a*, 7'*a*. Thus, as shown on the right-hand side of FIG. 3, the two planishing systems can be withdrawn from stand 1 and placed in a withdrawn position 2*a*, 2'*a* by rolling on rails 18, 18'. Displacement of the upper system is performed when the planisher is in the open position shown in FIG. 2.

To adjust the distribution of the planishing rate, it is sufficient to act on the profile of a single planishing system, for example upper system 2, by means of bearing jacks 7. In this case, lower planishing system 2' simply bears upon upper face 71' of lower bearing beam 11, preferably via a row of bearing girders 76 distributed across the entire width of lower bearing beam 11 in a manner so as to correspond, respectively, to the rows of bearings 52' of bearing rollers 5'.

Preferably, each girder 76 will be covered with a hard metal strip 78 on which small plates 75' fixed to plate 21' bear. Plate 21 constitutes a shim whose thickness can, if necessary, be varied to give, for example, a certain camber to plate 21' supporting lower planishing system 2'.

Figure 4:
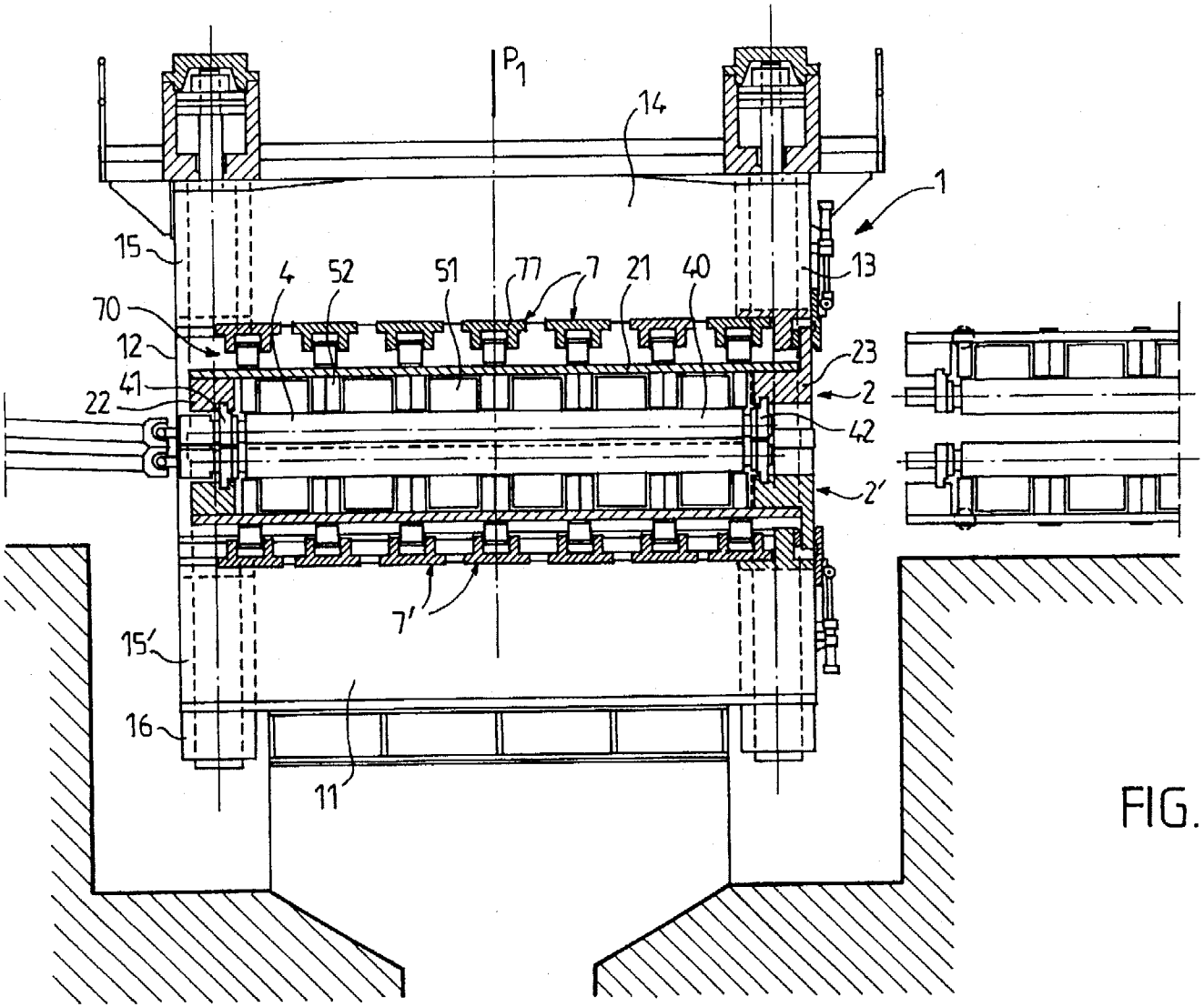
FIG. 4 shows another embodiment of the installation, presented as a cross-sectional view along its vertical median plane perpendicular to the feed direction.

However, it is also possible to produce an entirely symmetrical installation, as shown in FIGS. 4 and 5, with the two planishing systems being associated, respectively, with two series of adjustment jacks 7, 7', bearing, respectively, on upper bearing beam 14 and on lower bearing beam 11.

Thanks to the arrangements just described, it is furthermore possible to determine the absolute position of the end of each actuator 7, taking into account any possible deformation of the supporting stand in order to compensate for the yields of the different parts of the latter and to maintain each live roll 4 at the prescribed level.

For this purpose, sensors (not shown) can be arranged between one or more reference components and the resistant bearing beam 14 or deformable plate, to detect the deformations of the latter and adjust the positions of the actuators so as to maintain the desired imbrication by correcting the yield of the stand recorded by the different sensors. The reference component can be a rigid rule not subject to the deformations and fixed to the supporting stand by articulations.

As a result, it is no longer necessary, even for very high planishing forces, to increase in an excessive way the rigidity of the supporting stand, it being possible to take into account and compensate for any deformation of the stand.

Moreover, adjusting the position of the actuators, possibly during product feed, makes it possible to maintain constant the adjustment of the imbrications of the rolls both in the longitudinal direction of the machine and in the transversal direction, irrespective of any variation in the planishing forces.

The machine just described can also be associated with a preadjustment model which takes into account the characteristics of the different mechanical parts.

Moreover, adjustment jacks 7 make it possible to adjust, in the three dimensions, the profile of deformable plate 21 and, in turn, that of bearing rolls 5, in order to distribute the stresses applied to the live rolls, while differentiating, for example, the planishing rates produced between the center and edges of the sheet according to the nature of the flatness faults detected.

In addition, the sliding assembly of the upper bearing beam makes it possible to limit the distance of travel of the adjustable actuators to just the small distance required to adjust imbrication and compensate sections. On the other hand, the large opening possibility of the bearing beam facilitates introduction of the product, especially a hooked product, and also access to the rolls of the two systems.

Moreover, the cartridge mounting of the two systems facilitates their maintenance and replacement when the need arises.

It is advantageous to produce the two systems in the same way in the form of interchangeable cartridges, although, for purposes of simplification, a conventional fixed lower system could also be used.

Likewise, the machine just described exhibits a very high degree of adjustment flexibility, but could also be simplified by reducing the number of adjustable actuators associated with each live roll. Moreover, each row of actuators could, for example, act in the vertical plane passing between two adjacent live rolls.

We claim:

1. A planishing installation for a metal strip moving in a longitudinal feed direction, said installation comprising;

(a) a fixed supporting stand having two vertical members spaced on either side of a longitudinal median plane;

(b) two spaced resistant bearing beams, namely, a lower bearing beam and an upper bearing beam;

(c) upper and lower planishing systems having parallel rolls respectively located above and below said strip, said rolls being so imbricated as to provide an undulating path for said strip, said lower planishing system bearing upon said lower bearing beam and said upper planishing system bearing upon said upper bearing beam;

(d) each of said upper and lower planishing systems comprising a row of parallel live rolls bearing upon a supporting chassis via at least one row of bearing rolls, said live rolls having ends rotatably mounted each on two bearings defining an axis of rotation of each live roll perpendicular to said feed direction of said strip;

(e) said supporting chassis of at least one of said upper and lower planishing systems comprising two side components for supporting said bearings of said live rolls and a deformable plate extending between said two side components and covering an entire surface covered by said live rolls;

(f) a plurality of actuators having an adjustable length and comprising an element bearing upon said upper bearing beam and an element bearing via one bearing end upon said deformable plate, the adjustable actuators are arranged in rows parallel to the axes of the live rolls, each row comprising at least two actuators spaced from each other symmetrically on either side of the longitudinal median plane of the stand, the number and distribution of the actuators being a function of the size of the installation and technological constraints;

(g) said planishing system being associated with means for individually adjusting the position of the bearing end of each actuator in relation to the bearing beam.

2. The planishing installation of claim 1, wherein each live roll is associated with a row of actuators distributed over the entire length of the roll, said actuators being centered in a plane perpendicular to the feed direction and passing substantially through the axis of the corresponding live roll.

3. The planishing installation of any preceding claim, wherein each live roll is associated with at least one bearing roll comprising at least two aligned rollers turning on two end bearings and at least one intermediate bearing, each bearing being mounted on a supporting member fixed directly upon said deformable plate, said deformable plate reproducing a profile defined by the ends of the individually adjustable actuators, with a corresponding deformation of said bearing rolls.

4. The planishing installation of claim 1, wherein the adjustment of the actuators is effected in advance to give the bearing surface a profile determined according to the characteristics of the product to be planished.

5. The planishing installation of any one of claims 1 or 2, including means for permanently adjusting the position of the actuators during the passage of the strip between the planishing systems.

6. The planishing installation of any one of claims 1 or 2, wherein each actuator is associated with mechanical means of the screw-nut type for adjusting the position of the bearing end in relation to the deformable plate.

7. The planishing installation of any one of claims 1 or 2, wherein each adjustable actuator is made up of a hydraulic or pneumatic actuator comprising a jack body provided in a supporting piece fixed onto the bearing beam and a piston associated with a rod bearing upon the chassis, all the jacks of the adjustable system being connected to a supply circuit comprising means for individually adjusting the position of each said jack.

8. The planishing installation of claim 3, wherein each bearing roll is made up of a series of aligned rollers supported by spaced centering bearings, mounted on supporting members fixed directly onto the deformable plate at points distributed across the surface thereof in rows parallel to the axes of the rolls.

9. The planishing installation of claim 8, wherein each centering bearing of a bearing roll corresponds to an adjustable actuator placed in position at the same place, on the opposite face of the deformable plate and bearing against it via a rounded face.

10. The planishing installation of claim 8, wherein the positions of the actuators are distributed between the centering bearings of the bearing rolls, with the deformable plate ensuring distribution of forces.

11. The planishing installation of any one of claims 1 or 2, wherein the chassis of the upper planishing system is supported by at least three hydraulic or pneumatic jacks bearing upon the fixed stand in a manner so as to press the chassis against the adjustable actuators, said actuators being supplied with at least enough pressure to balance the weight of the planishing system.

12. The planishing installation of any one of claims 1 or 2, wherein the lower bearing beam bears against a foundation block between the two side vertical members, and wherein the upper bearing beam is mounted so as to slide vertically along the two side vertical members of the supporting stand and is associated with means for adjusting its position.

13. The planishing installation of claim 11, wherein the adjustable system is supported by the upper bearing beam in a manner so as to move with it between an open, strip introduction position for which the adjustable system is well distanced from the fixed planishing system and a tightened planishing position corresponding to a determined spacing of said planishing systems, starting from which the imbrication of the rolls is adjusted by the actuators.

14. The planishing installation of claim 13, wherein each side vertical member of the stand consists of two spaced columns, the mobile bearing beam being provided with four guide sleeves which slide respectively on said columns and come to bear, in the tightened position, upon the corresponding parts of the fixed bearing beam, each column being associated with a jack for controlling the sliding movement of the mobile bearing beam, it being possible to supply the jacks under low pressure in order to move the mobile bearing beam between the open position and the tightened position, and inversely, and under high pressure, in the tightened position, in order to preload the columns of the stand while maintaining the distance between the two bearing beams.

15. The planishing installation of claim 3, wherein each planishing system containing the live rolls, the bearing rolls and the supporting chassis comprising a deformable plate and two longitudinal girders for supporting the bearings, forms an interchangeable cartridge comprising rolling parts integral with the chassis and able to bear on rollers mounted in rotary fashion on the stand for withdrawing or placing in position said cartridge.

* * * * *